US006386090B2

(12) United States Patent
Iwamori et al.

(10) Patent No.: US 6,386,090 B2
(45) Date of Patent: May 14, 2002

(54) PISTON TYPE COMPRESSOR

(75) Inventors: Hidekazu Iwamori; Tomomi Ohno; Takayuki Kato; Masahiro Yokota, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/775,075

(22) Filed: Feb. 1, 2001

(30) Foreign Application Priority Data

Feb. 4, 2000 (JP) ..... 12-028198

(51) Int. Cl.[7] ..... F01B 3/00; F16J 1/00
(52) U.S. Cl. ..... 92/71; 92/172
(58) Field of Search ..... 92/71, 12.2, 129, 92/153, 158, 172

(56) References Cited

U.S. PATENT DOCUMENTS

| | | | | |
|---|---|---|---|---|
| 5,765,464 A | | 6/1998 | Morita | 92/71 |
| 5,842,406 A | * | 12/1998 | Hiramatsu et al. | 92/158 |
| 5,868,556 A | * | 2/1999 | Umemura | 92/71 X |
| 5,988,041 A | * | 11/1999 | Hiramatsu et al. | 92/71 |
| 6,010,313 A | * | 1/2000 | Kirura et al. | 92/71 X |

FOREIGN PATENT DOCUMENTS

| | | |
|---|---|---|
| JP | 9-105377 | 4/1997 |
| JP | 9-250451 | 9/1997 |
| JP | 11-201037 | 7/1999 |

* cited by examiner

*Primary Examiner*—John E. Ryznic
(74) *Attorney, Agent, or Firm*—Morgan & Finnegan, LLP

(57) ABSTRACT

The object of the present invention is to propose a compressor in which rotation of a piston is prevented without affecting a big unbalanced load to the piston and the manufacture of the piston is simplified.

The compressor comprises a housing having a cylinder bore therein, a drive shaft, a swash plate as a cam plate and a piston including a head portion and a neck portion. The housing and the piston are made of metal such as aluminium or an aluminium alloy. A rotation preventing member formed separately from the piston is mounted on the neck portion of the piston. The rotation preventing member is composed of a pair of rotation preventing portions, an abutting portion and a pair of caulking portions to mount to the neck portion. Those are made of metallic material such as iron series and formed in one body. The rotation preventing portion prevents the piston from rotating, cooperating with the contacting portion formed on the inner wall of the housing.

8 Claims, 6 Drawing Sheets

PISTON TYPE COMPRESSOR

BACKGROUND OF THE INVENTION

The present invention relates to a compressor for use in an air conditioner for vehicle, especially, a piston type compressor in which the rotation of the piston is prevented.

Conventionally, it is common that a rotation preventing member and the piston are formed integrally. For example, devices in FIG. 7 and FIG. 8(*a*) are disclosed in Japanese Unexamined Patent Publication No. 11-201037.

A drive shaft 101 is rotatably supported by a housing 102. A swash plate 13 as a cam plate is coupled with the drive shaft 101 to rotate integrally. A cylinder bore 102*a* is defined in the housing 102. A head portion 104*a* of a single-headed piston 104 is inserted into the cylinder bore 102*a*. A neck portion 104*b* of the piston 104 is arranged outside of the cylinder bore 102*a*. A pair of shoe seats or semi-spherical recesses 104*c* is inwardly recessed to define pockets in the neck portion 104*b* of the piston 104. A pair of shoes 105 is arranged in the neck portion 104*b* of the piston 104, and received by the shoe seats 104*c*. The peripheral portions of the swash plate 103 are slidably sandwiched between the shoes 105. The rotational movement of the swash plate 103 accompanying with the rotation of the drive shaft 101 is converted to the reciprocating movement of the piston 104 through the shoes 105. Then the compression cycle is performed such that a refrigerant gas is sucked into the cylinder bore 102*a*, compressed and discharged out.

A piston 104 is provided with a rotation preventing portion 106. The piston 104 and the rotation preventing portion 106 are formed integrally. The rotation preventing portions 106 are formed on the neck portion 104*b* of the piston 104 so as to protrude ahead and behind in the rotational direction of the swash plate 103, respectively. The rotation preventing portions 106 are formed such that the curvature of contacting surfaces 106*a* confronting a contacting portion 102*b* of the housing 102 is smaller than that of the head portion 104*a*. An axis of an arc of the rotation preventing portion 106 is different from that of an arc of the head portion 104*a*. The housing 102 and the piston 104 are made of aluminium or an aluminium alloy for reducing its weight. A coating layer is formed on the head portion 104*a* and the contacting surface 106*a* for preventing seizure between the housing 102 and the piston 104 and for improving wearproof of the piston 104. The contacting portion 102*b* prevents the rotation of the piston, cooperating with the rotation preventing portion 106.

The connecting structure between the piston 104 and the swash plate 103 through the shoes 105 allows the rotation around the axis S of the piston 104. If the piston 104 rotates significantly, the neck portion interferes with the rotating swash plate 103 and there is a possibility of causing vibration and noise. However, as shown in FIG. 8(*a*) as two dotted chain line, the amount of rotation of the piston 104 could be reduced by that one end of the rotation preventing portion 106 contacts with the contacting portion 102*b*. Therefore, the piston 104 does not interfere with the swash plate 103.

On the other hand, another type of compressor, in which the rotation preventing member and the piston are arranged separately, is disclosed in Japanese Unexamined Patent Publication No. 9-105377.

As shown in FIG. 8(*b*) and FIG. 9, a protruding portion 111 is formed on the end portion of the piston 110. The intermediate portion of an arched leaf spring 112 is fastened to the protruding portion 111 with a screw 113. As shown in FIG. 8(*b*), the leaf spring 112 is assembled such that both end portions 112*a* are pressed to the inner wall surface 114*a* of the cylinder block (housing) 114, slidably in the moving direction of the piston 110, respectively.

Generally, a piston is produced by performing machining process, coating process to form a coating layer to cover the surface, and polishing process etc. to the material formed by molding or forging. As the piston 104 disclosed in Japanese Unexamined Patent publication No. 11-201037, it becomes troublesome to machine the piston or form a coating layer on the piston by roll coating, for the rotation preventing portion 106 and the piston 104 are formed integrally and the axis of the arc of the rotation preventing portion 106 deviates from that of the arc of the contacting surface 106*a*.

On the other hand, a compressor disclosed in Japanese Unexamined Patent Publication No. 9-105377 has the following problems.

(1) The rotation prevention of the piston 110 is performed by the leaf spring 112 which is continually press-contacted to the inner wall surface 114*a* of the housing 114, and an unbalanced load is continually affected to a piston 110 from the leaf spring 112. Therefore, the inner wall surface 114*a* of the housing 114 to which the leaf spring 112 is press-contacted, is easily worn, and then the piston 110 is easily worn partially. To control the amount of rotation of the piston 110 under a required quantity, it needs to strengthen the spring force of the leaf spring 112. However, that makes the above problem remarkable.

(2) The protruding portion 111 is formed on the end portion of the piston 110 and the leaf spring 112 is fastened to it with the screw 113. Such a structure axially lengthen the piston 110 and increases the size of the compressor. Furthermore, it needs to machine the screw 113 and a tapped hole 115, and increases the manufacturing process.

SUMMARY OF THE INVENTION

The present invention was achieved by recognizing the above problems in the prior art. The purpose is to propose a compressor in which the rotation of the piston is prevented without affecting a big unbalanced load to the piston and the manufacture for the piston is simplified.

A piston type compressor comprises a housing having a cylinder bore therein, a drive shaft rotatably supported in the housing, a cam plate coupled on the drive shaft to rotate integrally therewith, a piston being operatively connected to the cam plate through a pair of shoes, the piston including a head portion and a neck portion, the head portion of the piston being inserted into the cylinder bore, and the cam plate converting rotation of the drive shaft to reciprocating movement of the piston through the pair of shoes. In the above compressor, the present invention has the following features. A rotation preventing member is formed separately from the piston and mounted on the piston. A contacting portion is formed in the housing. The rotation preventing member prevents rotation around the axis of the piston, by contacting with the contacting portion when the piston rotates by a certain angle.

According to the present invention, it is easy to machine the piston and to form a coating layer on the piston by roll coating etc., for the rotation preventing member is formed separately from the piston. During the running of the compressor, a moment around the axis of the piston acts to the piston, accompanied with the rotation of the swash plate, and the piston tends to rotate around the axis. However, when the piston rotates by a certain angle from the base portion, the rotation is prevented, for the rotation preventing member contacts the contacting portion. Therefore, the piston slides without receiving an unbalanced load, different from the structure that a leaf spring is used as the rotation preventing member.

Furthermore, the present invention has a following feature. The rotation preventing member is received in the piston. A stopper for preventing the relative movement of the rotation preventing member in the axial direction of the piston is arranged between the rotation preventing member and the piston. Accordingly, even after long use, the rotation preventing member is not separated from the piston by slipping in the axial direction of it.

Furthermore, the present invention has a following feature. The rotation preventing member is provided with a rotation preventing portion to prevent the rotation in both directions around the axis of the piston. Accordingly, one rotation preventing member can prevent the piston from rotating in both directions.

Furthermore, the present invention has a following feature. The above rotation preventing member is made of a different material from that of the housing. Accordingly, it does not need to form a coating on the rotation preventing member for avoiding the seizure, and then it is manufactured easily.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

FIG. 2(*b*) is a perspective view illustrating the piston provided with the rotation preventing member according to FIG. 2(*a*);

FIG. 4(*a*) is a rear elevation view illustrating the rotation preventing member according to FIG. 4;

DETAILED DESCRIPTION OF THE PREFERRED EMBODIMENTS

Figure 1:
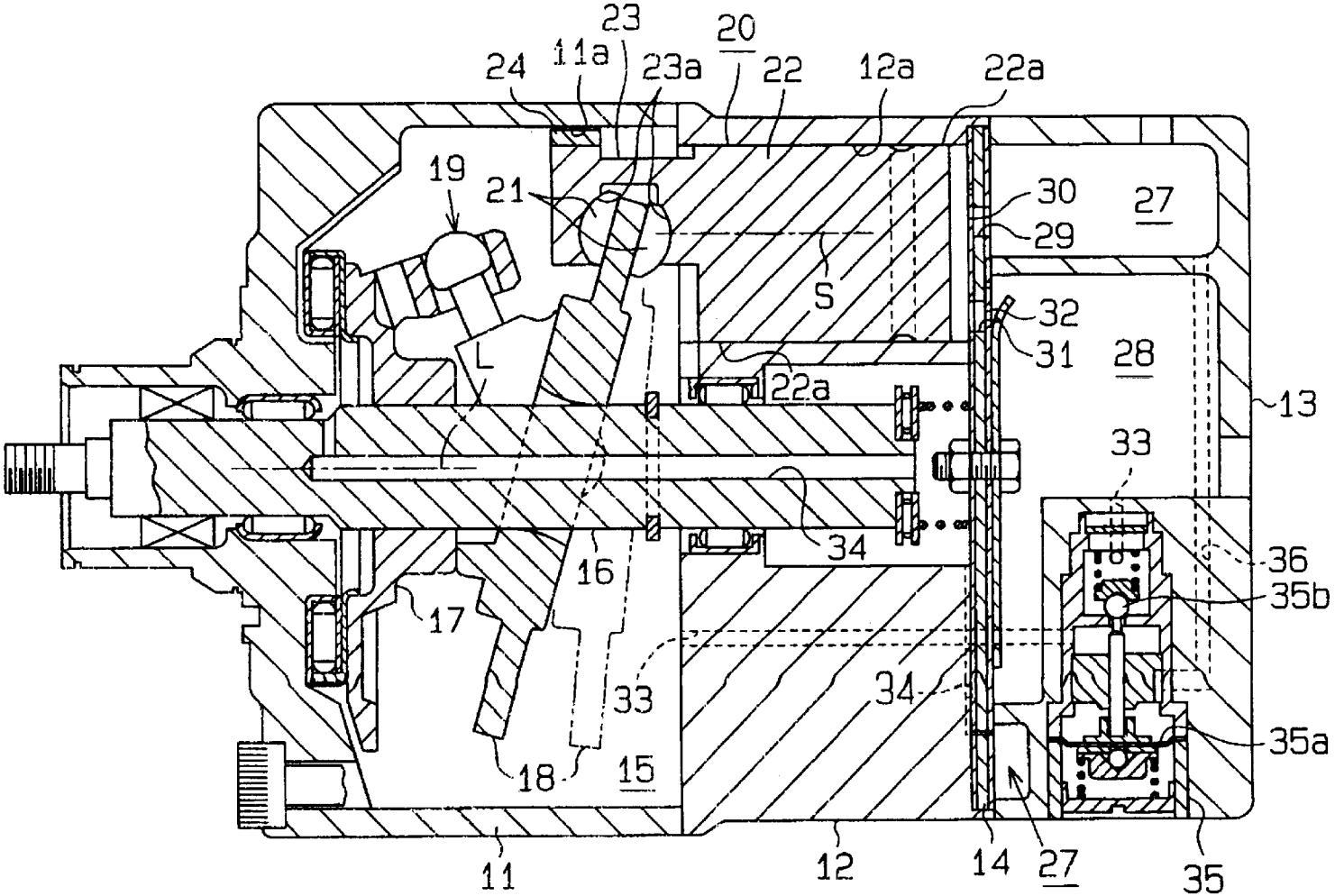
FIG. 1 is a cross-sectional view illustrating a compressor according to a first embodiment of the present invention.
Figure 2A:
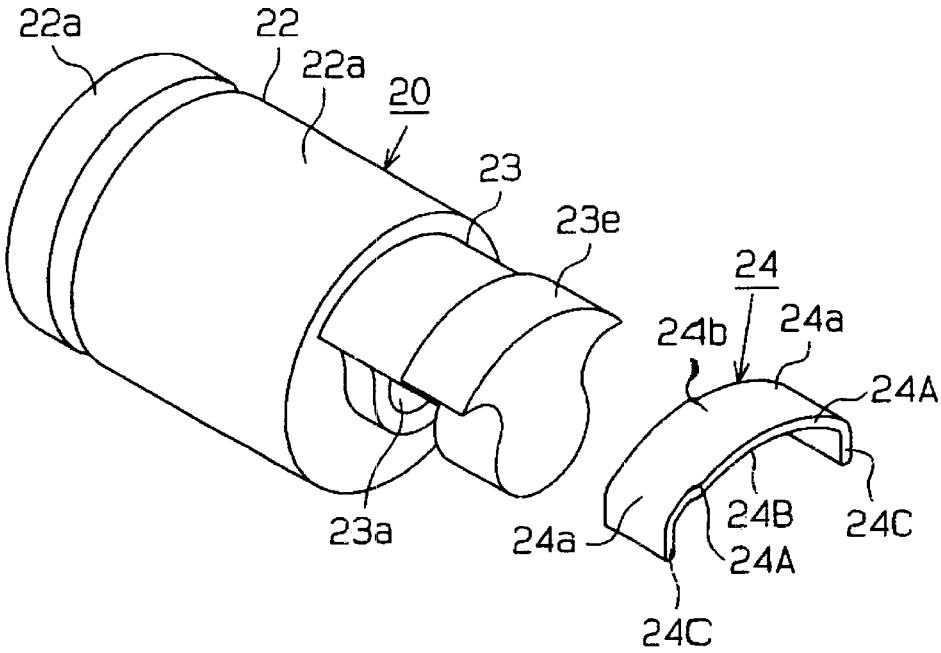
FIG. 2(*a*) is a perspective, exploded view illustrating a piston and a rotation preventing member according to the first embodiment of the present invention.
Figure 2B:
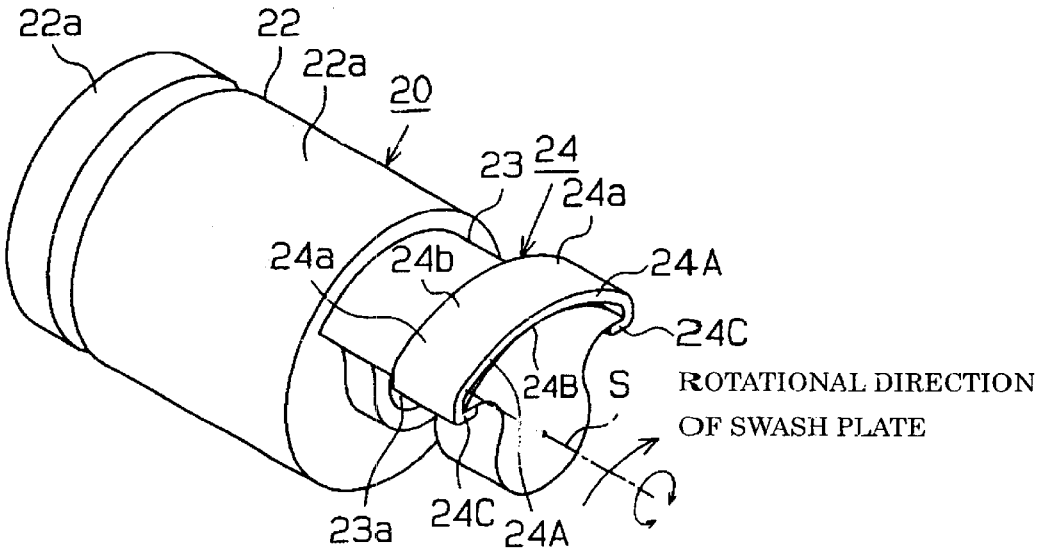
Figure 3:
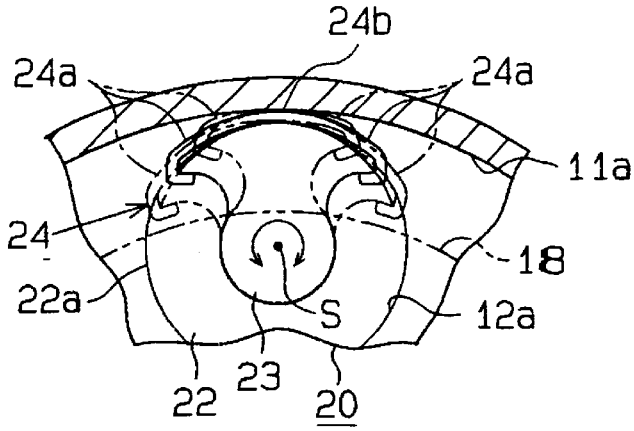
FIG. 3 is a schematic view illustrating the rotation preventing operation of the piston according to the first embodiment of the present invention.

Referring to FIG. 1 to FIG. 3, an embodiment according to the present invention will now be described.

As shown in FIG. 1, a variable displacement compressor of a single-headed piston type is illustrated. A front housing 11 is secured to the front end of a cylinder block 12 as a center housing. A rear housing 13 is secured to the rear end of the cylinder block 12 through a valve plate assembly 14. Both the housings 11, 13 and the cylinder block 12 are made of metallic material such as aluminium or an aluminium alloy.

A crank chamber 15 is defined by the front housing 11 and the cylinder block 12. A drive shaft 16 is rotatably supported between the front housing 11 and the cylinder block 12 so as to be inserted into the crank chamber 15. The drive shaft 16 is operatively connected to an engine of a vehicle as an external driving source (which is not illustrated), through a clutch mechanism such as an electromagnetic clutch. Accordingly, when the vehicle engine is operated, the drive shaft 16 is driven by the connection of the electromagnetic clutch.

A rotary support member 17 is mounted on the drive shaft 16 in the crank chamber 15. A swash plate 18 as a cam plate is supported inclinably on the drive shaft 16. A hinge mechanism 19 is located between the rotary support member 17 and the swash plate 18. The swash plate 18 is inclinable to the drive shaft 16 and rotatable integrally with the drive shaft 16 by the hinge connection through the hinge mechanism 19 to the rotary support member 17.

A plurality of (only one cylinder bore is illustrated in the drawings) cylinder bores 12*a* are formed to penetrate the cylinder block 12, around the axis L of the drive shaft 16. A plurality of single-headed pistons 20 are accommodated in the respective cylinder bores 12*a*. Especially each head portion 22 thereof is accommodated in each cylinder bore 12*a*, respectively. Each piston 20 is engaged with the swash plate 18 through each pair of shoes 21. Accordingly, the rotational movement of the drive shaft 16 is converted to the reciprocating movement of each piston 20 in each cylinder bore 12*a* through the swash plate 18 and each pair of shoes 21.

A suction chamber 27 and a discharge chamber 28 are defined in the rear housing 13. A suction port 29, a suction valve 30, a discharge port 31 and a discharge valve 32 are formed in the valve plate assembly 14. A refrigerant gas in the suction chamber 27 is sucked into the cylinder bore 12*a* through the suction port 29 and the suction valve 30 by the suction stroke of the piston 20. The refrigerant gas sucked into the cylinder bore 12*a* is compressed until a certain pressure by the compression stroke of the piston 20, and then it is discharged to the discharge chamber 28 through the discharge port 31 and the discharge valve 32.

A supply passage 33 communicates the discharge chamber 28 with the crank chamber 15. A bleeding passage 34 communicates the crank chamber 15 with the suction chamber 27. A displacement control valve 35 is interposed in the supply passage 33. A pressure sensing passage 36 communicates the suction chamber 27 with the displacement control valve 35.

A diaphragm 35*a* of the displacement control valve 35 senses the suction pressure introduced through the pressure sensing passage 36, and the displacement control valve 35 changes the opening degree of the supply passage 33 by moving the valve body 35*b* between the opening position and the closing position. When the opening degree of the supply passage 33 is changed, the amount of the discharged refrigerant gas introduced into the crank chamber 15 is changed, and the pressure in the crank chamber 15 is changed, in connection with the amount of the refrigerant gas relieved to the suction chamber 27 through the bleeding passage 34. Therefore, the difference between the pressure in the crank chamber 15 and the pressure in the cylinder bore 12*a* through the piston 20 is changed, and the inclination angle of the swash plate 18 is changed accordingly. As the result, the stroke of the piston 20 is changed, and the discharge capacity is adjusted accordingly.

Next, the construction of the piston 20 is described in detail.

As shown in FIG. 1 to FIG. 3, the piston 20 is composed of a head portion 22, which is cylindrical and inserted into the cylinder bore 12*a*, and a neck portion 23, which is arranged outside of the cylinder bore 12*a*. Those are made of metallic material such as aluminium or an aluminium alloy, and formed integrally. Shoe seats 23*a* are inwardly recessed to define pockets in the neck portion 23. A pair of shoes 21 is arranged in the neck portion 23 and its concave spherical portion is received by the shoe seats 23*a*. The swash plate 18 is slidably sandwiched by the shoes 21 at the front and the rear surfaces of its outer periphery. Though it is not shown, a resin coating layer for improving wearproof of the piston 20 is formed on the head portion 22.

A rotation preventing member 24 is mounted on a covered surface 23*e* which is formed at the rearward of the neck portion 23 of each piston 20. The covered surface 23*e* is formed as a part of a circumferential surface which has a same radius of curvature and a same axis as an outer circumferential surface 22*a* of the head portion 22. The covered surface 23*e* is machined at the same time as the outer circumferential surface 22*a*.

The rotation preventing member 24 is composed of a pair of rotation preventing portions 24A, an abutting portion 24B and a pair of caulking portions 24C to mount to the neck portion 23. Those are made of metallic material such as iron series and formed integrally. FIG. 2(*a*) is a perspective, exploded view illustrating the piston 20 and the rotation preventing member 24 which shows the state that a pair of caulking portions 24C are not yet caulked. The rotation preventing portions 24A are formed ahead of and behind in the rotational direction of the swash plate 18, sandwiching the abutting portion 24B. A contacting surface 24*a* as an arc surface is formed in the outer circumferential side of the rotation preventing portion 24A. An abutting surface 24*b* as an arc surface is formed in the outer circumferential side of the abutting portion 24B. The contacting surfaces 24*a* are connected through the abutting surface 24*b*. Both the contacting surfaces 24*a* and the abutting surface 24*b* are on the same arc surface. The radius of a curvature of the contacting surface 24*a* and the abutting surface 24*b* is larger than that of the outer circumferential surface 22*a* of the head portion 22, and is smaller than that of the inner wall surface of the front housing 11. The rotation preventing member 24 is mounted to the piston 20 by a pair of caulking portions 24C in a state that the rotation preventing member 24 is elastically deformed.

The piston 20 is arranged so that the abutting surface 24*b* and the contacting surface 24*a* face toward the inner wall surface of the front housing 11. The inner wall surface of the front housing 11 constitutes the contacting portion 11*a*. There is a clearance between the abutting surface 24*b* and the contacting portion 11*a*, and the contacting surface 24*a* and the contacting portion 11*a* when the rotation preventing member 24 is at the base position, as shown in FIG. 3 as a solid line. The contacting portion 11*a* prevents the rotation of the piston 20, cooperating with the rotation preventing portion 24A.

As shown in FIG. 3, the above described connecting structure between the piston 20 and the swash plate 18 through the shoes 21 allows the rotation of the piston 20 around the axis S thereof. Therefore, the piston 20 tends to rotate around its axis S when it receives any force. Especially, the shoes 21 tend to rotate to the same direction as the rotating direction of the swash plate 18 by the sliding connection therebetween. Accordingly, the piston 20 tends to rotate to the same direction as the rotating direction of the swash plate 18 (e.g. clockwise direction in FIG. 3) by the turning force of the swash plate 18 through the shoes 21.

However, as shown in FIG. 3, as two dotted chain lines, the abutment between the contacting surface 24*a* behind in the rotational direction and the contacting portion 11*a* prevents the rotation of the piston 20 to the same direction as the rotation of the swash plate 18, and the abutment between the contacting surface 24*a* ahead in the rotational direction and the contacting portion 11*a* prevents the rotation of the piston 20 to the opposite direction to the rotation of the swash plate 18 (counterclockwise direction in FIG. 3). As mentioned above, the rotation of the piston 20 is reduced, so that the neck portion 23 of the piston 20 does not interfere with the swash plate 18. Therefore, the occurrence of vibration or noise due to the interference of the piston 20 with the swash plate 18 is prevented.

The above embodiment has the following effects.

(1) As the rotation preventing member 24 is formed separately from the piston 20, it is easy to machine the piston 20 and to form a coating layer on it by a roll coating method etc.

(2) The rotation preventing portion 24A and the contacting portion 11*a* of the housing 11 contact each other when the piston 20 rotates by a certain angle from the base position. Therefore, the piston 20 normally slides without receiving an unbalanced load, and the piston 20 is not worn partially, accordingly.

(3) As the rotation preventing member 24 is made of different materials from those of the housing 11, it does not need to take any measures such as coating to avoid the seizure.

(4) As the covered surface 23*e* is a circumferential surface which has the same radius of curvature and the same axis as the outer circumferential surface 22*a*, it is easy to machine the piston 20 and to form a coating layer on the piston 20 by a roll coating method etc.

Embodiments are not limited to the above, but the followings also may be applied.

(1) The rotation preventing member may be made of metallic material except iron.

(2) The rotation preventing member 24 is made of metallic material such as aluminium series. And a coating layer such as resin coating and tin plate is formed on it for avoiding the seizure.

Figure 4:
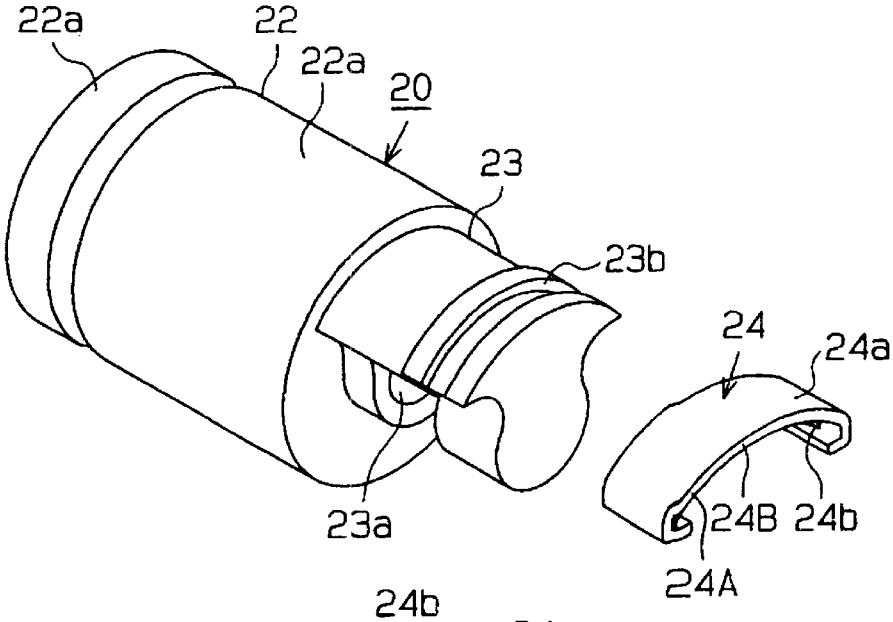
FIG. 4 is a perspective, exploded view illustrating the piston and the rotation preventing member according to a second embodiment of the present invention.
Figure 4A:
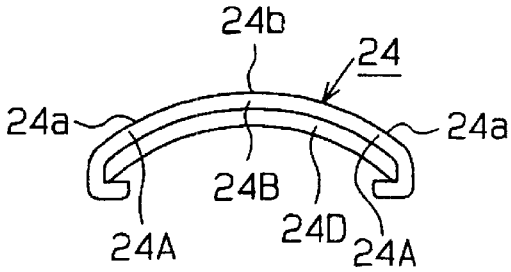

(3) The rotation preventing member 24 is engaged with the piston 20, and the relative movement of the rotation preventing member 24 in the axial direction of the piston 20 is prevented by a stopper. As shown in FIGS. 4 and 4(*a*), a protruding portion 24D on the rotation preventing member 24 and a concave portion 23*b* on the piston 20 compose a stopper. The rotation preventing member 24 is mounted on the piston 20 by fitting the protruding portion 24D to the concave portion 23*b*, and the rotation preventing member 24 is restricted its relative movement in the axial direction of the piston 20, accordingly.

(4) A coating layer for wear resistance may be formed on the rotation preventing member 24.

(5) The rotation preventing member 24 may be made of thermosetting resin.

(6) The rotation preventing member 24 may be mounted to the piston 20 by shrinkage fit.

Figure 5A:
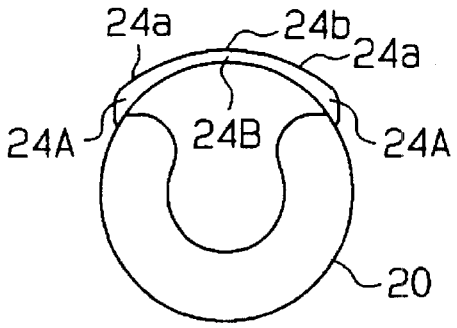
FIG. 5(*a*) and FIG. 5(*b*) are rear elevation views illustrating the pistons provided with the rotation preventing member according to a third and a fourth embodiments of the present invention, respectively.
Figure 5B:
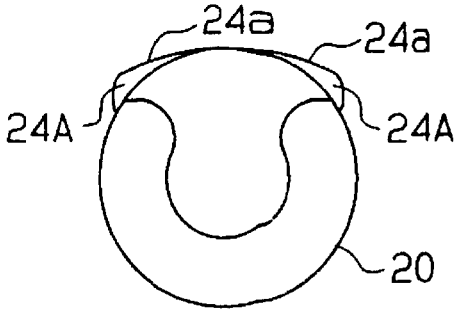

(7) As shown in FIG. 5(*a*), the rotation preventing member 24 may be mounted to the piston 20 by adhesion.

(8) As shown in FIG. 5(*b*), a pair of rotation preventing portions 24A does not necessarily connect each other through the abutting portion 24B and may be composed separately.

Figure 6A:
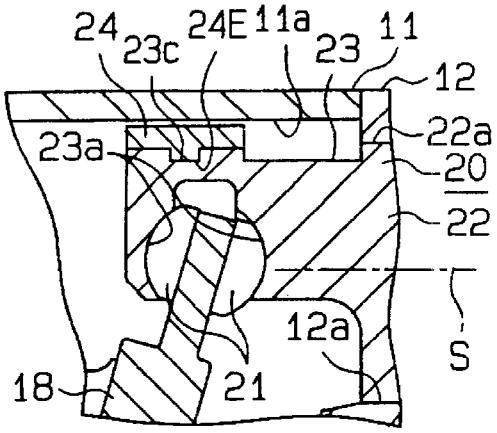
FIG. 6(*a*) and FIG. 6(*b*) are partial cross-sectional views illustrating compressors according to a fifth and a sixth embodiments of the present invention, respectively.
Figure 6B:
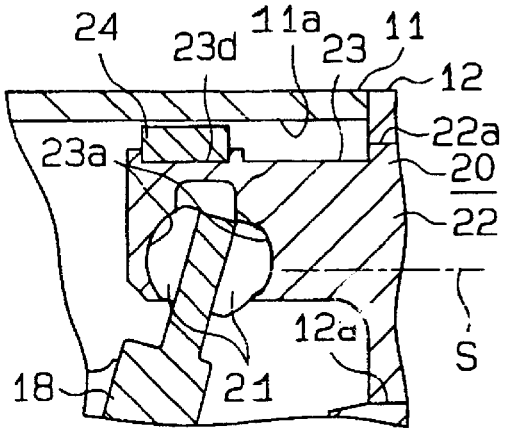
Figure 7:
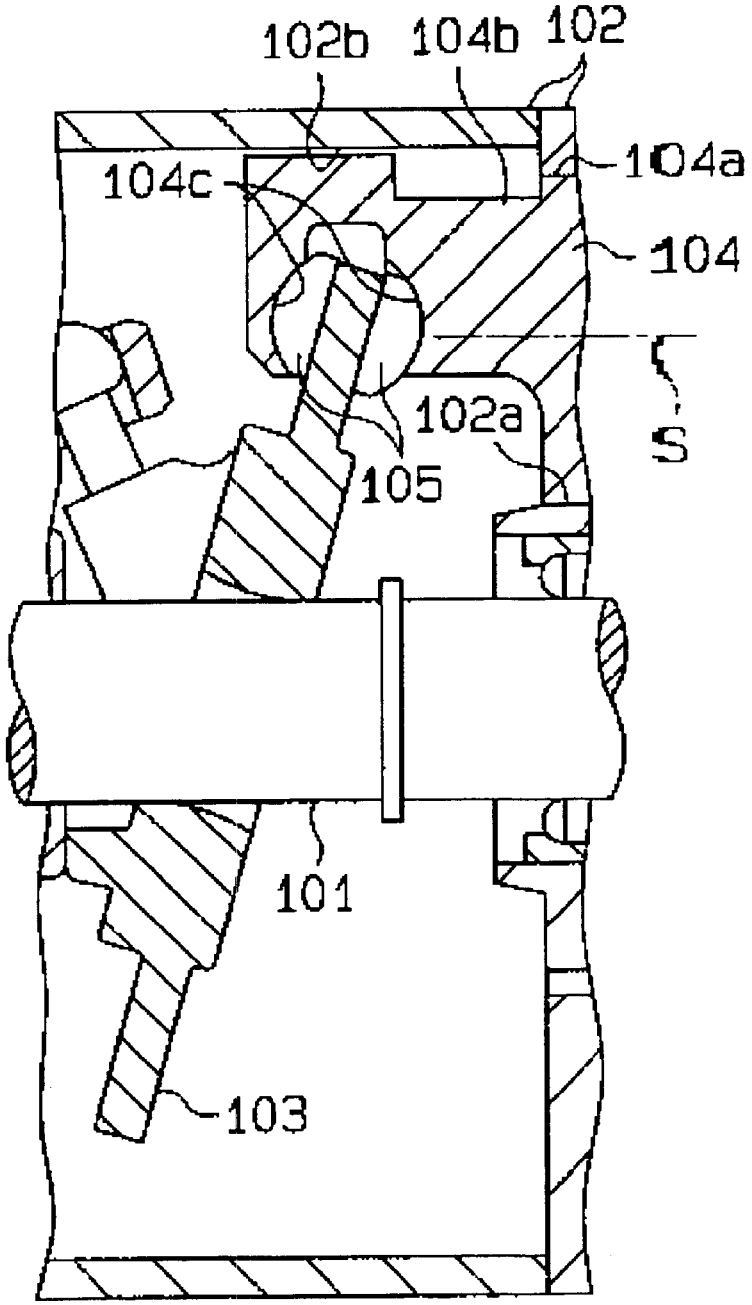
Fig. 7 (Prior Art)
FIG. 7 is a partial cross-sectional view illustrating a prior art compressor.
Figure 8A:
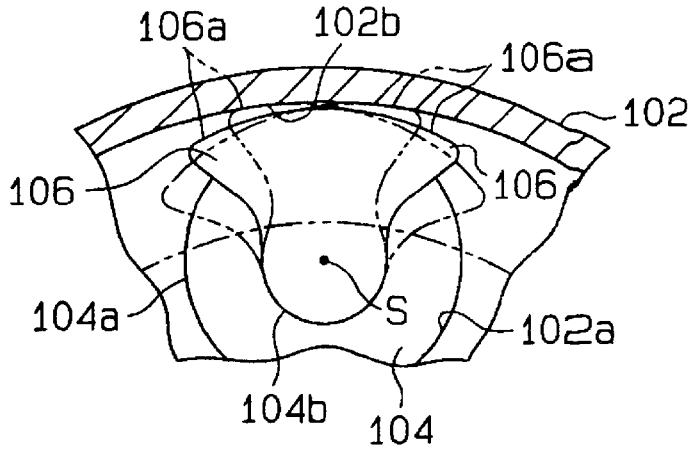
Fig. 8(a) (Prior Art)
FIGS. 8(*a*) and 8(*b*) are schematic views illustrating the rotation preventing operation of a first and a second prior art pistons, respectively.
Figure 8B:
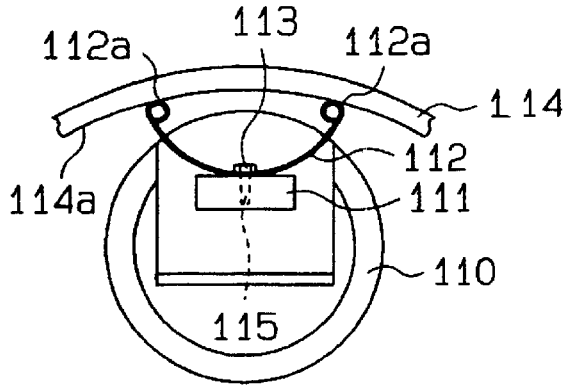
Fig. 8(b) (Prior Art)
Figure 9:
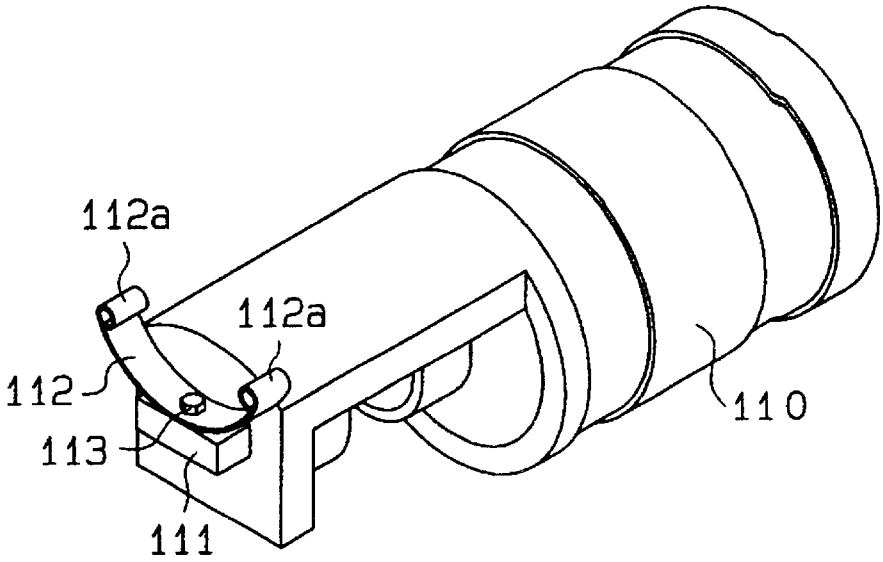
Fig. 9 (Prior Art)
FIG. 9 is a perspective view illustrating the piston according to FIG. 8(*b*).

(9) The rotation preventing member 24 is not necessarily mounted fixedly to the piston 20. As shown in FIG. 6(*a*), a protruding portion 24E formed on the rotation preventing member 24 may be mounted on the piston 20 by inserting it loosely into a concave portion 23*c* on the neck portion 23 of the piston 20 to function as a stopper. On the contrary, a protruding portion may be formed on the neck portion 23, and a concave portion may be formed on the rotation preventing member 24. Such composition makes it easy to assemble the rotation preventing member 24 into the piston 20.

(10) As shown in FIG. 6(*b*), the rotation preventing member 24 may be assembled into the piston 20 by inserting it loosely into the concave portion 23*d* formed on the neck portion 23 composing a stopper. Of course, the rotation preventing member 24 may be engaged with the neck portion 23.

(11) The invention may be embodied in the fixed displacement compressor.

(12) A pair of contacting surfaces 24*a* and the abutting surface 24*b* are not necessarily on the same arc. The contacting surfaces 24*a* and the abutting surface 24*b*, of which the centers of the arc are different, compose the contacting surface 24*a* and the abutting surface 24*b*.

(13) The contacting surface 24*a* may be formed in a plane surface.

(14) The abutting surface 24*b* may be formed in a plane surface.

(15) The compressor is not limited to a single-headed piston type, but also applied to a double-headed piston type.

(16) The compressor may be driven by a motor.

As mentioned above, according to the present invention, the rotation of the piston may be effectively prevented, and also the piston is manufactured easily.

Therefore the present examples and embodiments are to be considered as illustrative and not restrictive and the invention is not to be limited to the details given herein but may be modified within the scope of the appended claims.

What is claimed is:

1. A piston type compressor comprising:

a housing having a cylinder bore therein;

a drive shaft rotatably supported in the housing;

a cam plate coupled on the drive shaft to rotate integrally therewith;

a piston being operatively connected to the cam plate through a pair of shoes;

the piston including a head portion and a neck portion;

the head portion of the piston being inserted into the cylinder bore; and the cam plate converting rotation of the drive shaft to reciprocating movement of the piston through the pair of shoes;

a rotation preventing member formed separately from the piston and mounted on the piston;

a contacting portion formed in the housing; and wherein said rotation preventing member prevents rotation around the axis of the piston, by contacting with said contacting portion when the piston rotates by a certain angle.

2. A piston type compressor according to claim 1;

wherein said rotation preventing member being received in the piston; and a stopper to restrict the relative movement of said rotation preventing member in the axial direction of the piston is arranged between said rotation preventing member and the piston.

3. A piston type compressor according to claim 1;

wherein said rotation preventing member is provided with a rotation preventing portion to prevent rotation in both directions around the axis of the piston.

4. A piston type compressor according to claim 1;

wherein said rotation preventing member is made of different material from that of the housing.

5. A piston type compressor according to claim 1;

wherein said rotation preventing member is mounted to the piston by adhesion.

6. A piston type compressor according to claim 1;

wherein said rotation preventing member includes a plurality of rotation preventing portions, and they are arranged on the outer surface of the piston separately in the direction of the rotation of the piston.

7. A piston type compressor according to claim 2;

wherein said stopper includes a concave portion formed on the piston; and wherein said rotation preventing member being inserted into said concave portion loosely.

8. A piston type compressor according to claim 7;

wherein said rotation preventing member has a protruding portion composing said stopper; and wherein said protruding portion being inserted into said concave portion of the piston loosely.

* * * * *

UNITED STATES PATENT AND TRADEMARK OFFICE

CERTIFICATE OF CORRECTION

PATENT NO. : 6,386,090 B2
DATED : May 14, 2002
INVENTOR(S) : Iwamori et al.

It is certified that error appears in the above-identified patent and that said Letters Patent is hereby corrected as shown below:

Title page,
Item [30], Foreign Application Priority Data, please delete "12-028198" and insert therefor -- 2000-028198 --.

Signed and Sealed this

Eighth Day of October, 2002

*Attest:*

*Attesting Officer*

JAMES E. ROGAN
*Director of the United States Patent and Trademark Office*